US011663994B2

(12) United States Patent
Yang et al.

(10) Patent No.: US 11,663,994 B2
(45) Date of Patent: May 30, 2023

(54) CHIP SOLUTION DEVICE FOR DRIVING DISPLAY PANEL COMPRISING DISPLAY DRIVING INTEGRATED CIRCUIT (IC) AND DISPLAY CONTROL IC

(71) Applicant: MagnaChip Semiconductor, Ltd., Cheongju-si (KR)

(72) Inventors: Jin Seok Yang, Cheongju-si (KR); Jung Hoon Sul, Seoul (KR); Sang Kyung Kim, Daejeon (KR); Dae Young Yoo, Sejong-si (KR); Jae Won Kim, Seoul (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 210 days.

(21) Appl. No.: 16/860,317

(22) Filed: Apr. 28, 2020

(65) Prior Publication Data

US 2021/0005169 A1 Jan. 7, 2021

(30) Foreign Application Priority Data

Jul. 3, 2019 (KR) ..... 10-2019-0079872
Mar. 16, 2020 (KR) ..... 10-2020-0031864

(51) Int. Cl.
*G09G 5/395* (2006.01)
*G09G 5/00* (2006.01)

(52) U.S. Cl.
CPC ..... *G09G 5/395* (2013.01); *G09G 5/006* (2013.01); *G09G 2310/0291* (2013.01); *G09G 2310/08* (2013.01); *G09G 2320/0276* (2013.01); *G09G 2330/028* (2013.01); *G09G 2370/16* (2013.01)

(58) Field of Classification Search
CPC .... G09G 5/395; G09G 5/006; G09G 2370/08; G09G 2310/08; G09G 2320/0276; G09G 2320/08; G09G 2320/0673; G09G 2330/028; G09G 2320/0693; G09G 2310/0291; G09G 2370/14; G09G 2340/02; G09G 2370/16
See application file for complete search history.

(56) References Cited

U.S. PATENT DOCUMENTS 6,463,177 B1 * 10/2002 Li ..... H04N 5/772 375/E7.153
9,892,483 B2 2/2018 Lee et al.
10,096,304 B2 10/2018 Kim
2006/0208993 A1 * 9/2006 Jung ..... G06F 1/1616 345/98
2008/0046219 A1 * 2/2008 Chao ..... G01D 18/008 702/189
2009/0168141 A1 * 7/2009 Nakashima ..... H01B 1/122 359/275

(Continued)

*Primary Examiner* — Abbas I Abdulselam
(74) *Attorney, Agent, or Firm* — NSIP Law

(57) ABSTRACT

A device for driving a display panel includes a display driving integrated circuit (IC) configured to transmit image data to the display panel, a display control IC configured to receive compressed image data from a host and including a timing controller configured to control the display driving IC, and a non-volatile memory configured to transmit data to and receive data from the display control IC, and configured to store driving parameters necessary for operation of the display driving IC.

20 Claims, 11 Drawing Sheets

(56) References Cited

U.S. PATENT DOCUMENTS

| | | | | |
|---|---|---|---|---|
| 2010/0046607 | A1* | 2/2010 | Tseng | H04N 19/115<br>375/240.01 |
| 2017/0155917 | A1* | 6/2017 | Choi | H04N 19/50 |
| 2019/0131527 | A1* | 5/2019 | Bang | C23C 14/12 |
| 2020/0058008 | A1* | 2/2020 | Hicks | G07G 1/0081 |
| 2020/0111444 | A1* | 4/2020 | Shin | G09G 3/2096 |

* cited by examiner

CHIP SOLUTION DEVICE FOR DRIVING DISPLAY PANEL COMPRISING DISPLAY DRIVING INTEGRATED CIRCUIT (IC) AND DISPLAY CONTROL IC

CROSS-REFERENCE TO RELATED APPLICATIONS

This application claims the benefit under 35 U.S.C. 119(a) of Korean Patent Applications No. 10-2019-0079872 filed on Jul. 3, 2019 and No. 10-2020-0031864 filed on Mar. 16, 2020 in the Korean Intellectual Property Office, the entire disclosures of which are incorporated herein by reference for all purposes.

BACKGROUND

1. Field

The following description relates to a chip solution device for driving a display panel.

2. Description of Related Art

Recently, as size of screens of mobile terminals increase and the number of channels for a high resolution increases, two or more driving chips for driving a display panel may be used.

Typical approaches may include an example of a chip for driving a display panel in which a timing controller is embedded, which may provide an example of a chip solution device for driving a display panel.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a device for driving a display panel includes a display driving integrated circuit (IC) configured to transmit received image data to the display panel, a display control IC configured to receive compressed image data from a host and including a timing controller configured to control the display driving IC, and a non-volatile memory configured to transmit data to and receive data from the display control IC, and configured to store driving parameters necessary for operation of the display driving IC.

The display driving IC may include a first logic module and a driving interface module configured to transmit the image data to the display panel, and the display control IC may include a second logic module, a volatile memory, and a control interface module configured to perform image processing based on compressed image data received from the host and based on accessing the non-volatile memory.

The driving interface module may communicate with the display control IC using a Mobile Industry Processing Interface (MIPI) method.

The driving interface module may have a frequency bandwidth of about 0.75 to 2 times a frequency bandwidth of the control interface module.

The first logic module may include an analog control logic configured to drive the display driving IC, and the second logic module may include a timing controller configured to generate a clock signal used for driving the display driving IC.

The display driving IC may further include a first one time programmable (OTP) memory configured to store analog parameters used for the transmitting and receiving the image data with the display panel, and the display control IC may further include a second OTP memory configured to store at least one imaging parameter used for the image processing.

The at least one imaging parameter may include any one or any combination of any two or more of an image enhancement parameter, an image compression/restore parameter, and a panel compensation parameter.

The display control IC may be configured to receive compressed image data from the host, may store the compressed image data in the volatile memory, may process and restore the compressed image data in the second logic module based on the imaging parameters, and may transmit the compressed image data to the display driving IC.

The control interface module may communicate with the host and the display driving IC using a Mobile Industry Processor Interface (MIPI) method, and the control interface module may communicate with the non-volatile memory using a Serial Peripheral Interface (SPI) method.

The display driving IC may include a source amplifier and a gamma module configured to transmit image data to be displayed on the display panel.

The display driving IC may include a power/analog module configured to self-generate a power voltage used to drive the display panel.

The power voltage generated by the power/analog module may be from 1.8V to 30V, according to a display panel specification.

The display driving IC may be manufactured using a fine process, and the display control IC may be manufactured using an ultra-fine process.

In another general aspect, a device for driving a display panel includes a display driving integrated circuit (IC) configured to transmit received image data to the display panel, a display control IC configured to receive compressed image data from a host, and configured to restore the received data for transmission to the display driving IC, and a non-volatile memory configured to transmit and receive data with the display control IC and configured to store driving parameters used for operating the display driving IC.

The display control IC may include a data compressor configured to recompress the compressed image data received from the host after the restoring, wherein the display driving IC may include a data restorer configured to restore the recompressed and transmitted image data.

A ratio of recompressing image data in the data compressor may be a lower ratio than a ratio used for the compressed image data received from the host.

The display control IC may communicate with the host and the display driving IC using a Mobile Industry Processor Interface (MIPI) method, and may communicate with the non-volatile memory using a Serial Peripheral Interface (SPI) method.

The display driving IC may be manufactured using a fine process, and the display control IC may be manufactured using an ultra-fine process.

In another general aspect, a device for driving a display panel includes display driving integrated circuits (ICs) configured to transmit received image data to a display panel, a display control IC configured to receive compressed image data from a host and including a timing controller, and configured to control the display driving ICs, and a non-volatile memory configured to transmit and receive data with the display control IC and configured to store driving parameters used for operating the display driving ICs.

The display driving ICs and the display control IC may communicate using a Mobile Industry Processor Interface (MIPI) method.

In another general aspect, a device for driving a display panel includes a display driving integrated circuit (IC) configured to transmit image data to the display panel, including an analog control logic configured to drive the display driving IC, a display control IC configured to receive compressed image data, including a timing controller configured to control the display driving IC by generating a clock signal, and a memory configured to exchange data with the display control IC and configured to store driving parameters used by the display driving IC.

The memory may be a non-volatile memory.

The display control IC may further include a volatile memory and a control interface module configured to perform image processing based on received compressed image data from a host, based on accessing the non-volatile memory.

The display driving IC may further include a driving interface module configured to transmit the image data to the display panel.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
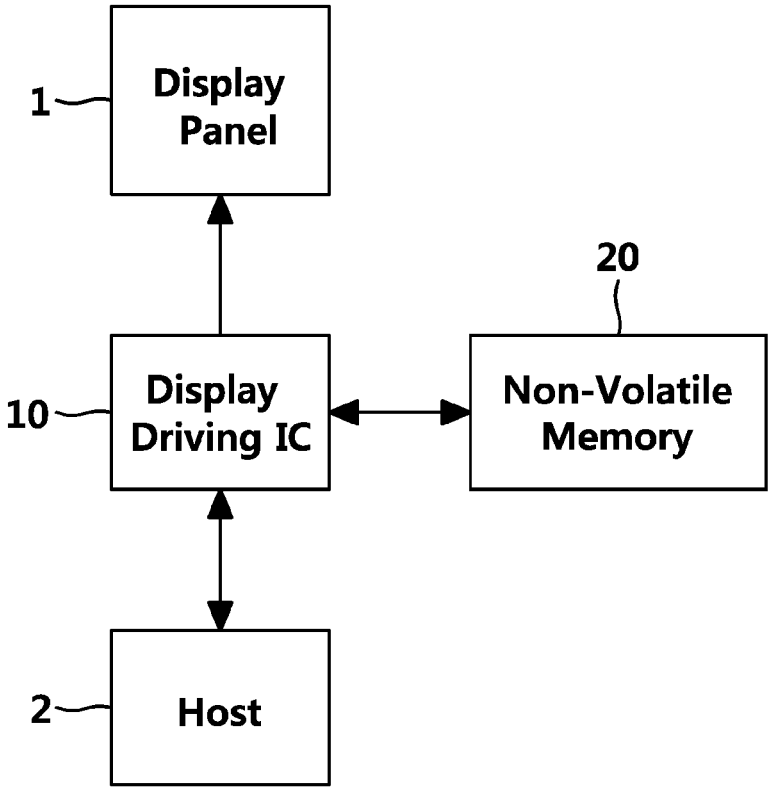
FIG. 1 illustrates an example of a chip for driving a display panel.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

Herein, it is noted that use of the term "may" with respect to an example or embodiment, e.g., as to what an example or embodiment may include or implement, means that at least one example or embodiment exists where such a feature is included or implemented while all examples and embodiments are not limited thereto.

On the other hand, unless otherwise defined, all terms used in this specification should be regarded as having the same meaning as generally understood by a person having ordinary skill in the art to which the present disclosure pertains after an understanding of the present disclosure. Accordingly, unless explicitly defined herein after an understanding of the present disclosure, certain terms should not be construed in excessively ideal or formal sense.

In addition, "about", "substantially" and the like in the present specification are used in the sense of the numerical value or close to the numerical value when manufacturing and substance tolerances unique to the stated meaning are presented, and to prevent unconscionable abusers from unduly using the disclosure with accurate or absolute figures to help understanding of the present disclosure.

The features of the examples described herein may be combined in various ways, as will be apparent after an understanding of the disclosure of this application. Further, although the examples described herein have a variety of configurations, other configurations are possible as will be apparent after an understanding of the disclosure of this application.

FIG. 1 illustrates an example of a chip for driving a display panel in which a timing controller is embedded.

Referring to the example of FIG. 1, a display device may include a display panel 1, a display driving integrated circuit (IC) 10, a non-volatile memory 20 and a host 2, in a non-limiting example.

The non-volatile memory 20 may store information having a large size such as parameters such as a register value or driving information of the display driving IC 10 among command signals. The display driving IC 10 may process data and command signals received from the host 2 based on the information of the non-volatile memory 20, and may transmit such signals to the display panel 1. The display panel 1 may display an image based on the data and command signals received from the display driving IC 10.

Between the host 2 and the display driving IC 10, it may be possible to transmit/receive data compressed by a Display Stream Compression (DSC) method according to the Mobile Industry Processor Interface (MIPI) convention. Between the display driving IC 10 and the non-volatile memory 20, data may be transmitted and received by a Serial Peripheral Interface (SPI) method.

The host 2 may transmit the image data to be displayed on the display panel 1 to the display driving IC 10 in a compressed format. Then, the display driving IC 10 may restore the compressed image data at the frame memory module and subsequently transmit the image data to the display panel 1. As such, the display driving IC for mobile may usually be implemented as a single chip, and the display driving IC for high-resolution mobile operation may use ultra-fine processing due to the increase in resolution, the addition of data processing functions, and the use of high-speed interfaces and large-capacity memory, such as dynamic random-access memory (DRAM), static random-access memory (SRAM), and so on, as non-limiting examples. However, even though the analog block may be implemented with such an ultra-fine process, the physical area of the analog block is not reduced, and as the ultra-fine process is used, the area occupied by analog block in the display driving IC for mobile may increase. This increase may act as a factor that may hinder the efficiency compared to the manufacturing cost of display driving ICs for mobile use.

Figure 2:
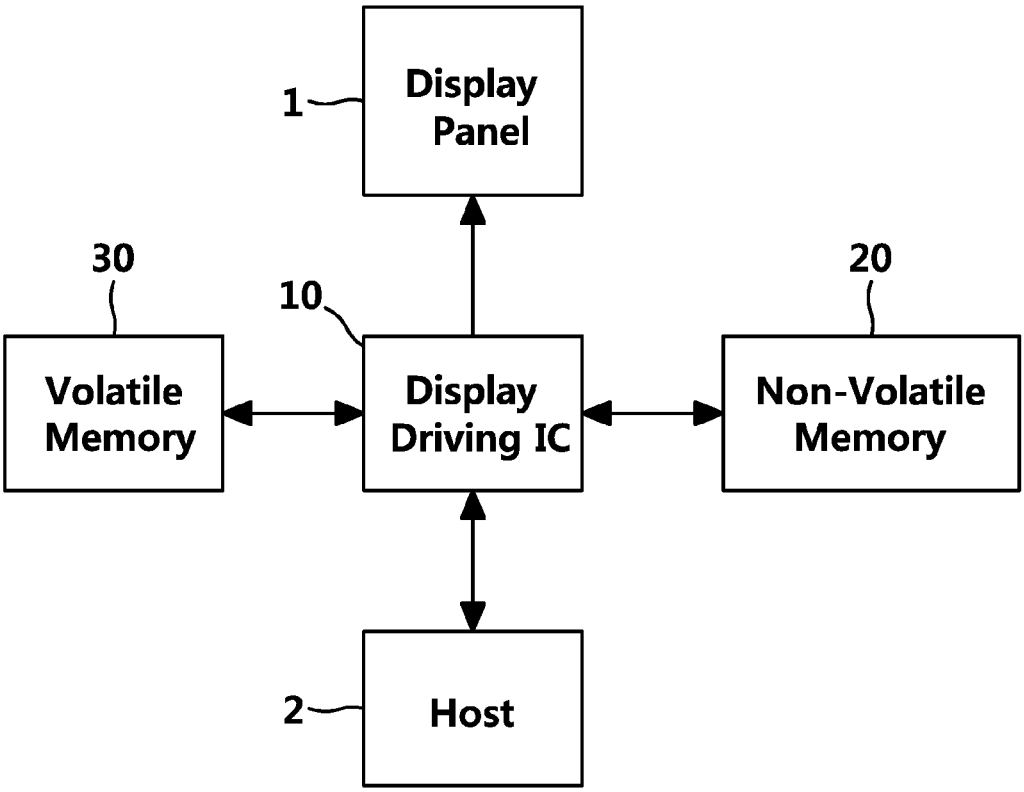
FIG. 2 illustrates an example of a chip solution device for driving a display panel.

In order to help address this problem, recently, as illustrated in the example of FIG. 2, a technology for a chip solution for display driving device for disposing a separate memory from a display driving chip outside the display driving IC may be used.

FIG. 2 illustrates an example of a chip solution device for driving a display panel.

When comparing the example of FIG. 2 with the example of FIG. 1, the volatile memory 30 may be implemented as a separate chip from the display driving IC 10.

The volatile memory 30 may include a memory implemented by DRAM or SRAM, such as discussed above, and a separate high-speed interface for communicating between the memory and the display driving IC 10.

The display driving IC 10 may receive the compressed image data from the host 2 and transmit the received compressed image data to the volatile memory 30. When the volatile memory 30 restores the received compressed image data and sends it back to the display driving IC 10, the display driving IC 10 may transmit the restored image data through the source amplifier to the display panel 1. At this time, a separate high-speed interface may be required to perform high-speed data transmission and reception to the volatile memory 30 for fast image processing in the display driving IC 10. Fast image processing in the display driving IC 10 may require high-speed processing of 3 to 5 times faster that of the DSC communication of the example of FIG. 1, according to the resolution of the image and image processing functions to be processed.

However, in such an example, problems such as current increase and electromagnetic interference (EMI) may occur due to the high-speed interface between the volatile memory 30 and the display driving IC 10. Even if the volatile memory 30 is separately implemented, the volatile memory 30 may be implemented with the analog function including the timing controller still being within the display driving IC 10, such that there may still be a difficulty that a ultra-fine process may have to be used to produce the chip solution device for driving the display panel of the example of FIG. 2.

Figure 3:
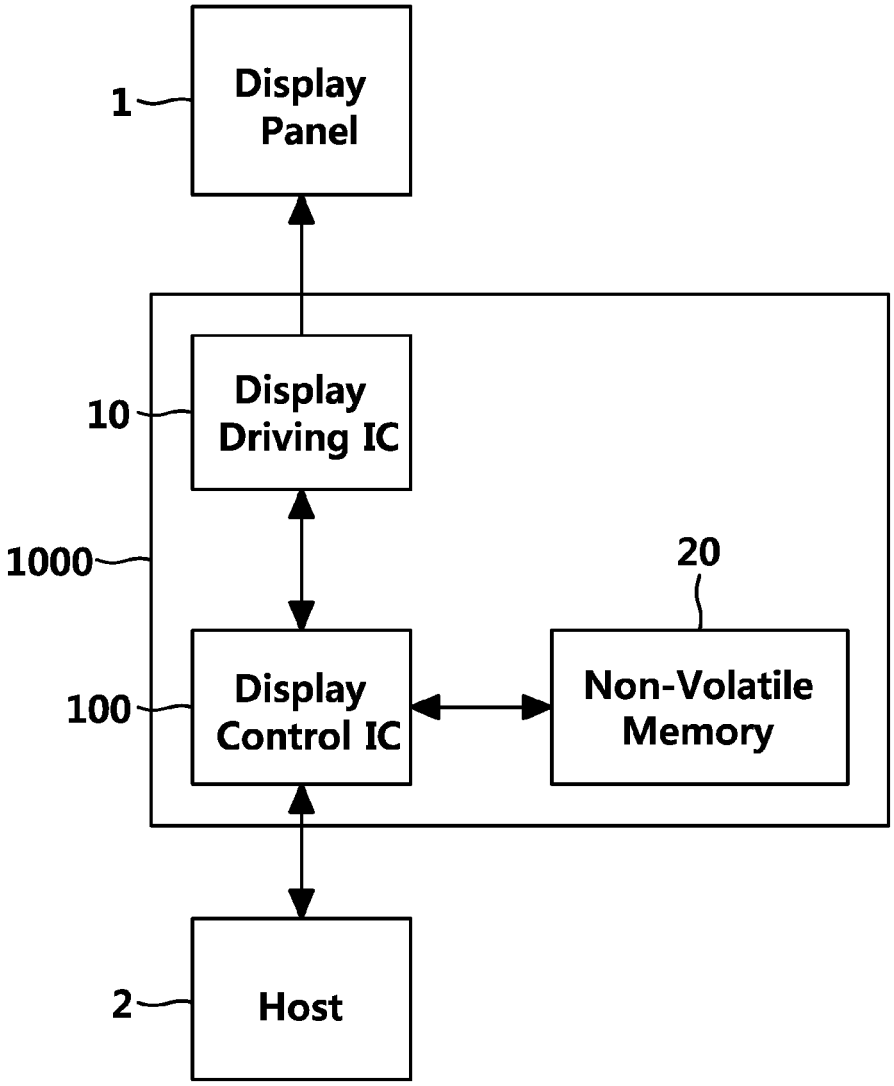
FIG. 3 illustrates a schematic configuration of a chip solution device for driving a display panel of the present examples.

FIG. 3 illustrates a schematic configuration of a chip solution device for driving a display panel of the present examples.

Referring to the example of FIG. 3, the chip solution device for driving a display panel 1000 according to one or more examples may be connected to the display panel 1 and the host 2, and may display an image on the display panel 1 based on the control signal received from the host 2 and the data signal.

The chip solution device for driving a display panel 1000 may include a display driving IC 10, a display control IC 100, and a non-volatile memory 20, according to a non-limiting example. The display driving IC 10 and the display control IC 100 may each be implemented as separate chips. For example, the display driving IC 10 may implemented by using a fine process, for example, a process of about 40 nm or more, and the display control IC 100 may be implemented in an ultra-fine process, for example, a process of about 28 nm, and then these elements may be configured as a chip solution device for driving a display panel 1000.

For example, in the example of an analog block connected to each channel of the display panel 1, because the area occupied may be large, such an example may be implemented in the display driving IC 10 by using a fine process that may be implemented at a relatively low cost. However, a configuration related to image processing that may require high-speed processing, such as a configuration using a timing controller and a frame memory, may be implemented in a display control IC 100 that is a separate chip that may be made by using an ultra-fine process. Likewise, by implementing each of the separate chips using a fine process and an ultra-fine process, respectively, one or more examples may have an effect of providing for a simpler system configuration and a reduced processing cost.

Descriptions of the display driving IC 10 and the display control IC 100 are provided in greater detail after the example of FIG. 3.

The non-volatile memory 20 may be implemented separately from the display control IC 100 or may be embedded in the display control IC 100, according to one or more examples.

Figure 4:
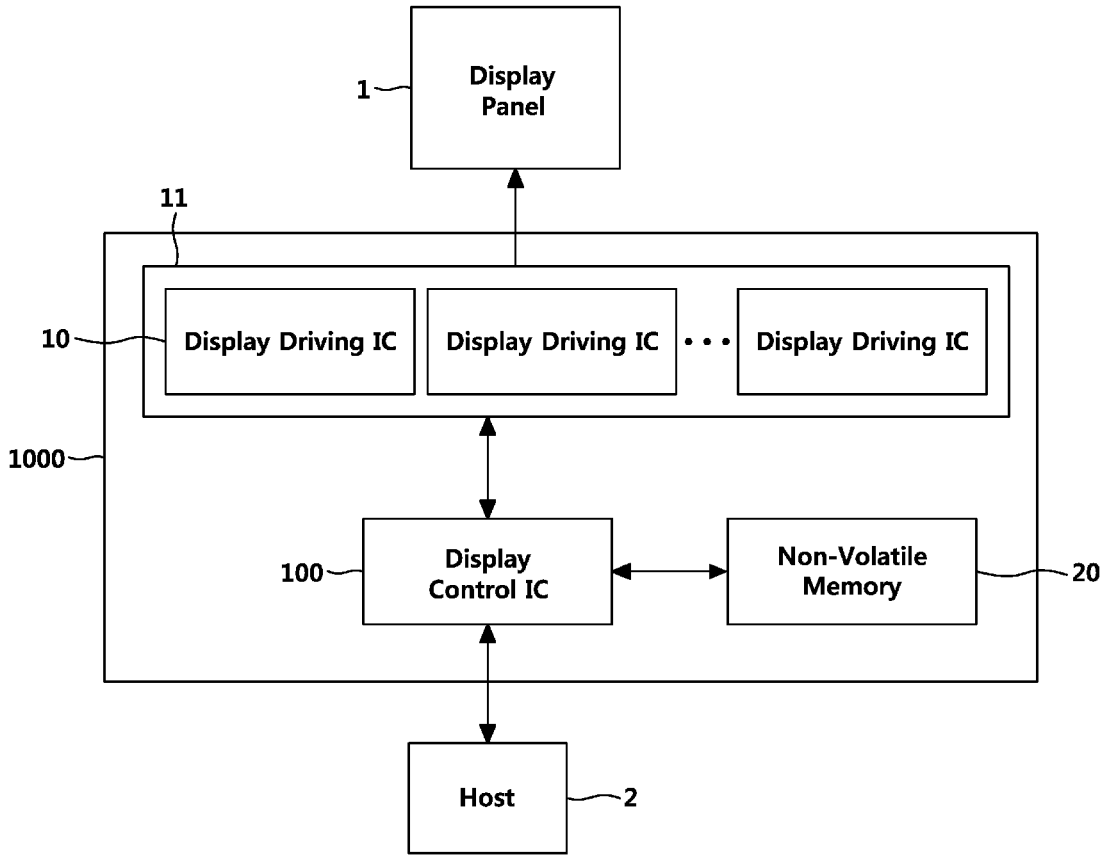
FIG. 4 illustrates another configuration of a chip solution device for driving a display panel illustrated in the example of FIG. 3.

FIG. 4 illustrates another configuration of a chip solution device for driving the display panel illustrated in the example of FIG. 3.

Referring to the example of FIG. 4, the chip solution device for driving a display panel 1000 may include a plurality of display driving ICs 11. In such an example, the display control IC 100 may control the plurality of display driving ICs 11. In addition, each of the display control IC 100 and the plurality of display driving ICs 11 may communicate using a MIPI method.

Figure 5:
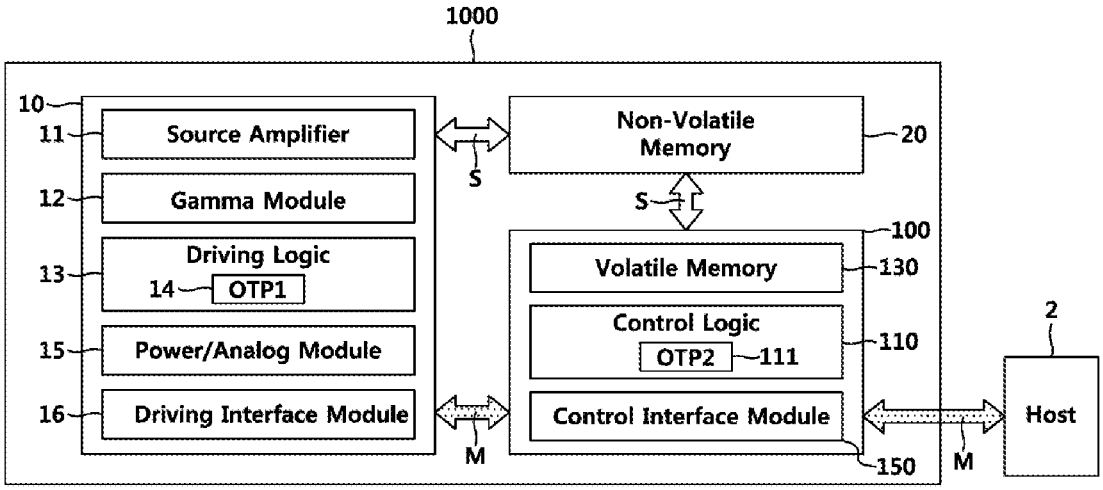
FIG. 5 illustrates the schematic configuration diagram illustrated in the example of FIG. 3 in greater detail.

FIG. 5 illustrates a schematic configuration diagram of a chip solution device for driving the display panel illustrated in the example of FIG. 3 in greater detail.

Referring to the example of FIG. 5, the display driving IC 10 may transmit a signal to the display panel 1. The display driving IC 10 may include a source amplifier 11, a gamma module 12, a driving logic unit or driving logic 13, a first OTP memory 14, a power/analog module 15, and a driving interface module 16, as a non-limiting example.

The source amplifier 11 and the gamma module 12 may each be connected to a channel of the display panel 1. The source amplifier 11 may transmit a data signal for an image to be displayed to the display panel 1.

The driving logic 13 may include the remaining analog control logic for driving the display driving IC, except for the timing control and image processing functions. The driving logic 13 may also be referred to as a first logic module.

The first OTP memory 14 may store an analog parameter for driving the display panel 1. Such an analog parameter may be a parameter required for the driving logic 13 and the power/analog module 15. The analog parameter may include, for example, a driving voltage trimming parameter.

The power/analog module 15 may self-generate a power voltage required for driving the display panel. Depending on the display panel specifications, high voltages from 1.8 V to 20 to 30 V may be generated.

The driving interface module 16 may be connected to the display control IC 100, in order to transmit and receive data and driving signals. The driving interface module 16 may communicate with the display control IC 100 by using a MIPI method (M). In one or more examples, the driving interface module 16 may not communicate directly with the external memory, but may communicate through the display control IC 100. That is, the driving interface module 16 may have a frequency bandwidth of about 0.75 to 2 times the bandwidth of the control interface module 150, such that the current consumption due to the increase in the bandwidth of the transmitted/received data is not greatly increased by comparison to the example of FIG. 2 and an electromagnetic interference (EMI) problem otherwise occurring may not occur. That is, the image data compressed in the host may be stored in the memory inside the display control IC. Subsequently, the display driving IC 10 may receive the restored image data from the display control IC 100 and then only displays the image on the panel. This approach may be used because it one or more examples may make it unnecessary to directly receive the compressed image data and directly write it to the memory.

The display control IC 100 may perform image processing based on a signal received from the host, and may access the non-volatile memory 20 to control driving of the display driving IC 10. The display control IC 100 may include a control logic unit or control logic 110, a second OTP memory 111, a volatile memory 130, and a control interface module 150, as a non-limiting example.

The control logic 110 may include logic used for performing image processing. For example, a timing controller for generating a clock for driving the display driving IC 10 may be included in control logic 110. The control logic 110 may also be referred to as a second logic module.

The second OTP memory 111 may store imaging parameters necessary for image processing. The imaging parameter may be a parameter related to image processing, and may be, for example, any one or any combination of any two or more of an image enhancement parameter, an image compressing/restoring parameter, and a panel compensation parameter.

The volatile memory 130 may store the compressed image received from the host 2 before performing image processing, according to one or more non-limiting examples, or may partially store an image processed by the control logic 110, that is, a restored image, and then transmits information in a lump to the display driving IC 10, according to one or more other non-limiting examples.

The control interface module 150 may transmit and receives compressed images and control signals from the host 2, and may transmit and receive processed images and driving signals to and from the display driving IC 10. The control interface module 150 may communicate with the host 2 and the display driving IC 10 by using a Mobile Industry Processor Interface (MIPI) method (M). As described in greater detail above, the control interface module 150 may implement a frequency bandwidth interfacing with the display driving IC 10 to provide about 0.75 to 2 times the data frequency bandwidth interfacing of that with the host 2.

In one or more examples, the control interface module 150 may communicate with the non-volatile memory 20 by using a Serial Peripheral Interface (SPI) method (S). In one or more examples, the non-volatile memory 20 may also communicate directly with the display driving IC 10.

According to the chip solution device for driving the display panel of the present examples, data supplied from the display control IC 100 to the display driving IC 10 may isolate the interface while utilizing the existing MIPI method, which may provide for a constant high-speed interface frequency regardless of the size of the internal memory and the addition of an image processing function, unlike the typical example of FIG. 2, in which the interface speed with the volatile memory 30 is to be increased when an image processing function is added.

Figure 6:
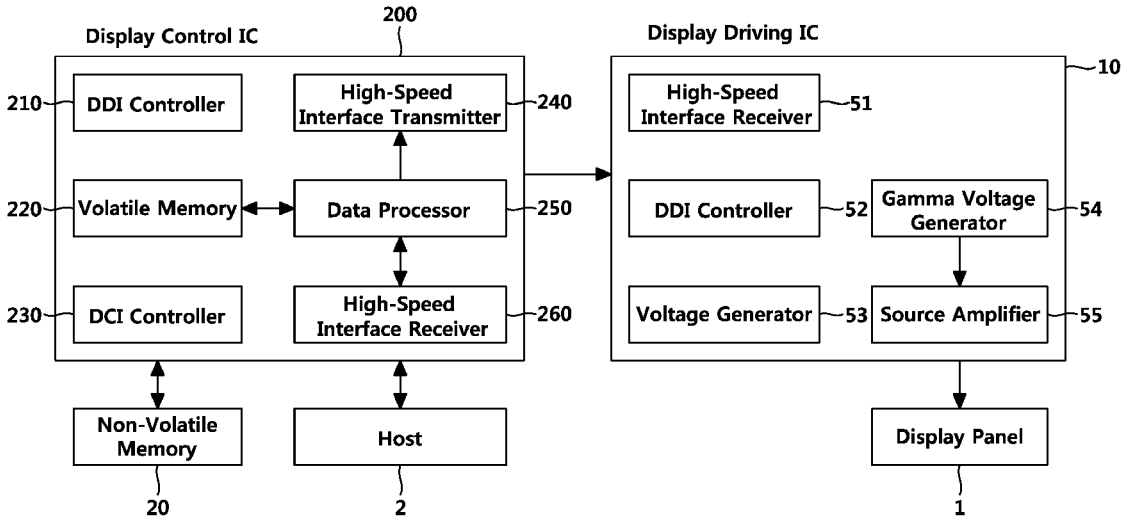
FIG. 6 is a first example of the chip solution device for driving a display panel illustrated in the example of FIG. 5 being reconstructed, according to image data flow.

FIG. 6 is a first example illustrating a detailed configuration diagram of a chip solution device for driving a display panel illustrated in the example of FIG. 5, according to an image data transfer procedure.

To help with the understanding of this portion of the disclosure, each component illustrated in the example of FIG. 6 is compared and described in advance with reference to comparable portions of the example of FIG. 5.

Among the components of the display control IC 200 of the example of FIG. 6, the display control IC (DCI) controller 230, the data processor 250, and the display driving IC (DDI) controller 210 may be included in the control logic 110 of the example of FIG. 5 and high-speed interface transmitter and receiver 240 and 260 are included in the control interface module 150 of the example of FIG. 5. In addition, among the components of the display driving IC 10 of the example of FIG. 6, the DDI controller 52 may be included in the driving logic 13 of the example of FIG. 5, and the high-speed interface receiver 51 may be included in the driving interface module 16 of the example of FIG. 5 and the voltage generator 53 may be included in the power/analog module 15 of the example of FIG. 5.

Referring to the example of FIG. 6, the display control IC 200 may include a DDI controller 210, a volatile memory 220, a DCI controller 230, a high-speed interface transmitter 240, a data processor 250, and a high-speed interface receiver 260, in a non-limiting example.

The DDI controller 210 may generate a driving signal that controls the display driving IC 10. For example, including a timing controller, a clock signal may be generated based on a control signal received from the host 2, and a gate signal for panel control and a diode emitting control signal may be generated as well.

The DCI controller 230 may control driving of the display control IC 200 based on a command input from the host 2 and a signal input from the non-volatile memory 20.

The data processor 250 may analyze the image processing and control signals based on the data received from the host 2. For example, the data processor 250 may perform image processing for restoring the compressed image received from the host 2 and an image enhancement for processing an image in high resolution, and so on.

By comparison with the example of FIG. 5, the example of FIG. 6 illustrates the control interface module 150 as being divided into a high-speed interface transmitter 240 and a high-speed interface receiver 260. The high-speed interface receiver 260 may interface with the host 2, and the high-speed interface transmitter 240 may interface with the display driving IC 10. In such an example, the high-speed interface transmitter 240 may have a frequency bandwidth of 0.75 to 2 times that of the high-speed interface receiver 260.

The volatile memory 220 may store frame images during image processing. That is, the configuration corresponding to the volatile memory of FIG. 5 may be implemented as an SRAM or a DRAM.

The display driving IC 10 may include a high-speed interface receiver 51, a DDI controller 52, a voltage generator 53, a gamma voltage generator 54, and a source amplifier 55, as a non-limiting example.

The high-speed interface receiver 51 may be connected to the display control IC 200 using a MIPI method to receive a processed image, that is, a restored image and a control signal.

The DDI controller 52 may generate a driving signal for driving the display panel 1 based on the control signal and the driving parameters stored in the non-volatile memory. For example, the DDI controller 52 may be responsible for generating a gamma control and a controlling analog block.

The voltage generator 53 may generate a driving voltage required for driving the display panel 1 based on the driving signal.

The gamma voltage generator 54 may generate a gamma voltage corresponding to grayscale information.

The source amplifier 55 may be connected to each channel of the display panel 1, and may transmit image data.

Figure 7:
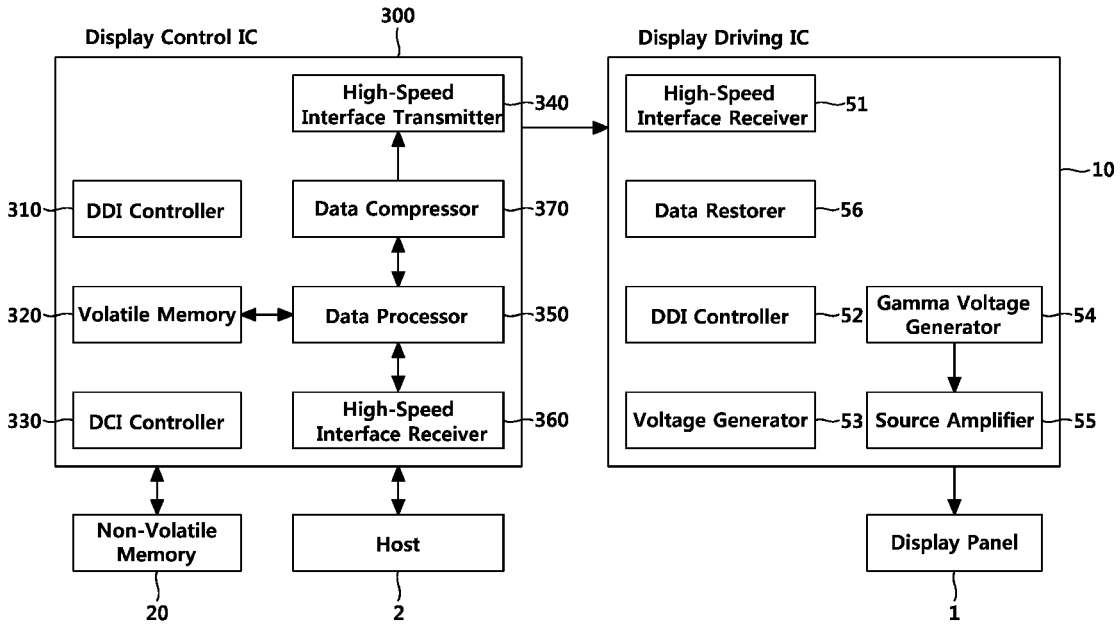
FIG. 7 is a second example of the chip solution device for driving a display panel illustrated in the example of FIG. 5 being reconstructed, according to image data flow.

FIG. 7 is a second example illustrating a detailed configuration diagram of the chip solution device for driving the display panel illustrated in the example of FIG. 5, illustrated according to the order of image data transfer procedure. For convenience of description, the example of FIG. 7 will be described based on differences from the example of FIG. 6. Referring to the example of FIG. 7, the data compressor 370 and the data restoring unit or data restorer 56 may be further included in addition to the example of FIG. 6. The data compressor 370 may be included in the control logic 110, and the data restorer 56 may be included in the driving logic 13. In order to reduce the high-speed interfacing frequency between the display control IC 300 and the display driving IC 10, the data compressor 370 may compress the image processed by the data processor 350 at a predetermined ratio that may be lower than the ratio of compressing in the host. Because the compression ratio is lower, the original compressed data was more compressed. The data restorer 56 may then restore the processed image, which was compressed and transmitted, based on the predetermined ratio. The DDI controller 52 may generate a driving signal based on the processed image data.

By further including a data compressor 370 and a data restorer 56, the chip solution device for driving a display panel may have a lower high-speed interfacing frequency, which may accordingly further reduce power consumption, and thus EMI generation may be reduced, as well.

Description of the remainder of the configuration in the example of FIG. 7 is omitted as it is the same as corresponding portions of the example of FIG. 6.

Figure 8:
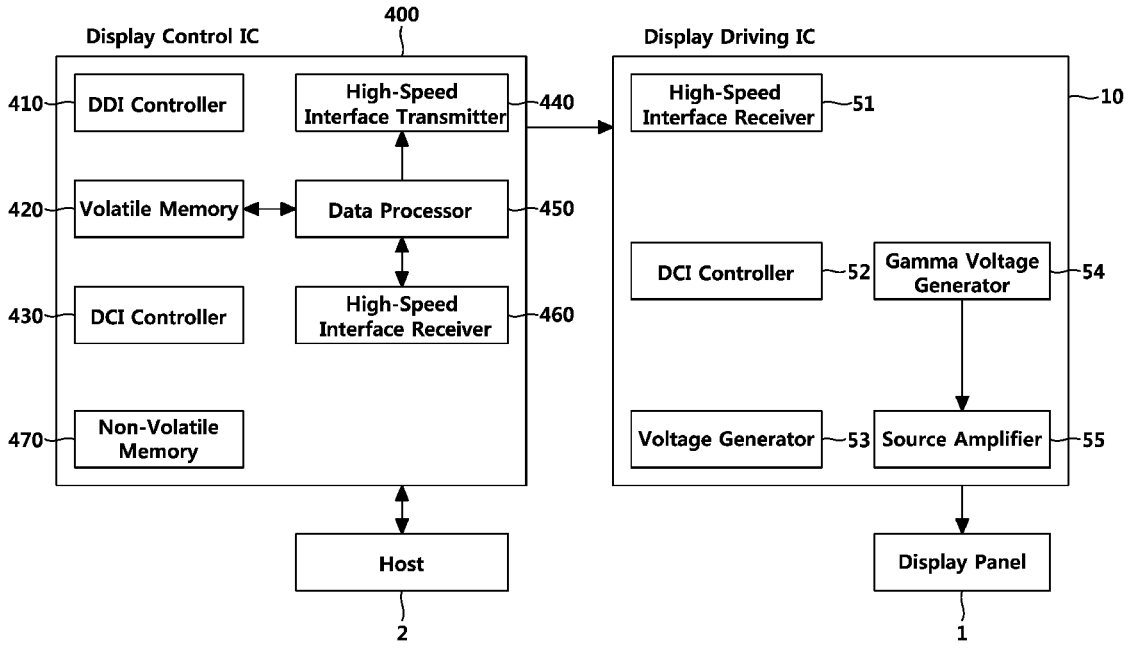
FIG. 8 is a third example of the chip solution device for driving a display panel illustrated in the example of FIG. 5 being reconstructed, according to image data flow.

FIG. 8 is a third example of a detailed configuration diagram of a chip solution device for driving a display panel illustrated in the example of FIG. 5, illustrated according to the order of image data transfer procedure. For convenience of description, FIG. 8 is described based on its differences from FIG. 6.

The display control IC 400 of the example of FIG. 8 may be implemented by embedding of a non-volatile memory 470. Accordingly, the number of parts of the mobile device may be reduced, and accordingly, the area on the substrate and the pin connecting to the external device from the display control IC may be reduced, as well.

In addition, it is described and explained with reference to the examples of FIGS. 9, 10 and 11 that a chip solution device for driving the display panel may be configured through the display control IC 400 and the non-volatile memory 470 or other chip, or the non-volatile memory 470 and a chip other than the display control IC, and having one packaging.

Figure 9:
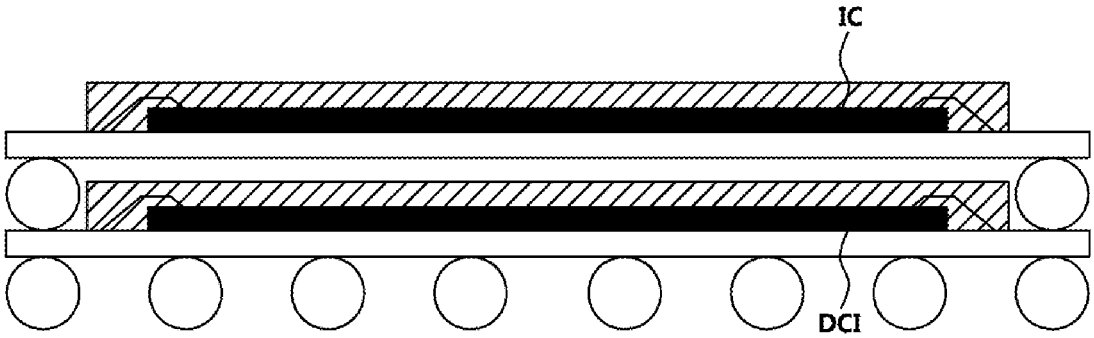
FIGS. 9 to 11 illustrate first to third examples of a module packaging method of a chip solution device for driving a display panel of the present examples.
Figure 10:
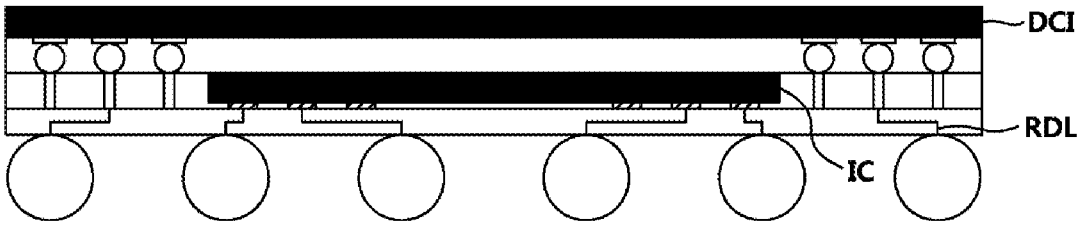
Figure 11:
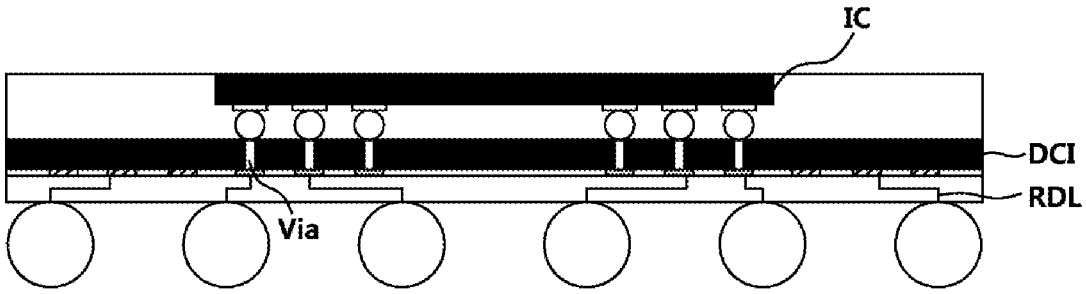

FIGS. 9 to 11 illustrate first to third examples of a chip solution device module packaging method for driving a display panel of the present examples.

Referring to the example of FIG. 9, when a chip solution device for driving a display panel is assembled on a flexible printed circuit board (FPCB) or a printed circuit board (PCB) for each chip, the chip solution device may be packaged by stacking a non-volatile memory IC or a touch IC on a display control IC (DCI). An additional bonding area may be provided at the edge of the substrate on which the display control IC is disposed, such that other chips may be stacked. FIG. 9 is illustrated so as to distinguish DCI and IC elements from each other.

Examples of FIGS. 10 and 11 show one or more examples in which separate chips are implemented as one package.

Referring to the example of FIG. 10, chips having a large area among the chips may be stacked on the top, and the wiring of the chips having a small area may be disposed to face the bottom surface. In addition, the pad may be packaged by connecting with an upper portion by using an RDL (ReDistribution Layer), and so on, in the edge of the lower chip. The chip having a small area may be a non-volatile memory chip or a touch chip, as non-limiting examples.

Referring to the example of FIG. 11, chips having a small area among the chips may be stacked on the top, and the wiring of the chip having a large area may be disposed to face the bottom surface. In addition, a via may be formed through the lower chip to connect the pad to the upper chip. At this time, the via may form bump pads on the bottom of the lower chip in a quantity that is as many as the number of pads of the lower chip and the upper chip, such that at least two chips may be implemented on a FPCB or PCB with a minimum package area.

As described above, according to the chip solution device for driving a display panel according to the present examples, there may be an effect that the system configuration may simpler and the processing cost may be reduced by implementing a display control IC using an ultra-fine process and a display driving IC using a fine process separately in a chip solution device and embedding them together.

According to the chip solution device for driving a display panel of the present examples, there may be an effect that the data supplied from the display control IC to the display driving IC may have a constant high-speed interface frequency regardless of the size of the internal memory and the addition of an image processing function.

According to the chip solution device for driving a display panel of the present examples, because the frequency of the high-speed interface is constant, there may be an effect of reducing consumption power due to the increase in frequency.

According to the chip solution device for driving a display panel of the present examples, there may be an effect of becoming stronger and/or more resistant to EMI effects by reducing the current consumption.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A device for driving a display panel, the device comprising:

a display driving integrated circuit (IC) configured to transmit received image data to the display panel;

a display control IC configured to receive compressed image data from a host and comprising a timing controller configured to control the display driving IC; and a non-volatile memory configured to transmit data to and receive data from the display control IC, and configured to store driving parameters necessary for operation of the display driving IC, wherein the display control IC is implemented as a separate chip using a process different from that of the display driving IC, and wherein the display control IC comprises a volatile memory configured to store the compressed image data from the host, such that the display control IC is configured to perform image processing based on the compressed image data stored in the volatile memory and access the non-volatile memory.

2. The device of claim 1, wherein the display driving IC comprises a first logic module and a driving interface module, and is configured to transmit the image data to the display panel.

3. The device of claim 2, wherein the display control IC further comprises a second logic module configured to perform image processing based on the compressed image data stored in the volatile memory.

4. The device of claim 2, wherein the driving interface module communicates with the display control IC comprising a control interface module using a Mobile Industry Processing Interface (MIPI) method.

5. The device of claim 4, wherein the driving interface module has a frequency bandwidth of about 0.75 to 2 times a frequency bandwidth of the control interface module.

6. The device of claim 4, wherein the first logic module comprises an analog control logic configured to drive the display driving IC, and wherein the display control IC comprises a second logic module that comprises the timing controller configured to generate a clock signal used for driving the display driving IC.

7. The device of claim 6, wherein the display driving IC further comprises a first one time programmable (OTP) memory configured to store analog parameters used for the transmitting and receiving the image data with the display panel, and wherein the display control IC further comprises a second OTP memory configured to store at least one imaging parameter used for the image processing.

8. The device of claim 7, wherein the at least one imaging parameter comprises any one or any combination of any two or more of an image enhancement parameter, an image compression/restore parameter, and a panel compensation parameter.

9. The device of claim 7, wherein the display control IC is configured to process and restore the compressed image data in the second logic module based on the imaging parameters, and transmit the restored compressed image data to the display driving IC.

10. The device of claim 6, wherein the control interface module communicates with the host using the Mobile Industry Processor Interface (MIPI) method, and the control interface module communicates with the non-volatile memory using a Serial Peripheral Interface (SPI) method.

11. The device of claim 1, wherein the display driving IC comprises a source amplifier and a gamma module configured to transmit image data to be displayed on the display panel.

12. The device of claim 1, wherein the display driving IC comprises a power/analog module configured to self-generate a power voltage used to drive the display panel.

13. The device of claim 12, wherein the power voltage generated by the power/analog module is from 1.8V to 30V, according to a display panel specification.

14. The device of claim 1, wherein the display driving IC is manufactured using a fine process, and the display control IC is manufactured using an ultra-fine process.

15. A device for driving a display panel, the device comprising:

a display driving integrated circuit (IC) configured to transmit received image data to the display panel;

a display control IC configured to receive compressed image data from a host, and configured to restore the received data for transmission to the display driving IC; and a non-volatile memory configured to transmit and receive data to and from the display control IC and configured to store driving parameters used for operating the display driving IC, wherein the display control IC is implemented as a separate chip using a process different from that of the display driving IC, and comprises a data compressor configured to recompress the compressed image data received from the host after the restoring at a predetermined ratio lower than a ratio of compressing in the host, and wherein the display driving IC comprises a data restorer configured to restore the recompressed and transmitted image data.

16. The device of claim 15, wherein the display control IC comprises a volatile memory configured to store the compressed image data received from the host, such that the display control IC is configured to perform image processing based on the compressed image data stored in the volatile memory and access the non-volatile memory.

17. The device of claim 15, wherein the display control IC communicates with the host and the display driving IC using a Mobile Industry Processor Interface (MIPI) method, and communicates with the non-volatile memory using a Serial Peripheral Interface (SPI) method.

18. The device of claim 15, wherein the display driving IC is manufactured using a fine process, and wherein the display control IC is manufactured using an ultra-fine process.

19. A device for driving a display panel, the device comprising:

a plurality of display driving integrated circuits (ICs) configured to transmit received image data to the display panel;

a display control IC configured to receive compressed image data from a host and comprising a timing controller, and configured to control the plurality of display driving ICs; and a non-volatile memory configured to transmit and receive data to and from the display control IC and configured to store driving parameters used for operating the plurality of display driving ICs, wherein the display control IC comprises a volatile memory configured to store the compressed image data from the host and a control interface module, such that the display control IC is configured to perform image processing based on the compressed image data stored in the volatile memory and access the non-volatile memory, and wherein the display control IC is implemented as a separate chip using a process different from that of the plurality of display driving ICs.

20. The device of claim 19, wherein each of the plurality of display driving ICs is manufactured using a fine process, and the display control IC is manufactured using an ultra-fine process.

* * * * *